US005476136A

United States Patent [19]

Leutwiler et al.

[11] Patent Number: 5,476,136

[45] Date of Patent: Dec. 19, 1995

[54] DEVICE FOR COMPACTING GRANULAR MOLDING MATERIAL

[75] Inventors: Hans Leutwiler; Kurt Fischer, both of Schaffhausen, Switzerland

[73] Assignee: Georg Fischer Giessereianlagen AG, Schaffhausen, Switzerland

[21] Appl. No.: 330,011

[22] Filed: Oct. 27, 1994

[30] Foreign Application Priority Data

Oct. 29, 1993 [CH] Switzerland ..... 3273/93

[51] Int. Cl.[6] ..... B22C 15/00; B22C 15/28

[52] U.S. Cl. ..... 164/195; 164/169

[58] Field of Search ..... 164/169, 195, 164/37, 38

[56] References Cited

U.S. PATENT DOCUMENTS 4,588,017 5/1986 Damm et al. ..... 164/169
5,148,852 9/1992 Oishi ..... 164/169
5,301,740 4/1994 Erana ..... 164/169 X
5,348,070 9/1994 Fischer et al. ..... 164/37 X

FOREIGN PATENT DOCUMENTS 638419 12/1978 U.S.S.R. ..... 164/37

*Primary Examiner*—J. Reed Batten, Jr.
*Attorney, Agent, or Firm*—Bachman & LaPointe

[57] ABSTRACT

The device comprises a pressure housing for storing a gaseous medium under pressure, a pattern plate for supporting a pattern, and a molding box of height H associated with the pattern plate and defining therewith a molding space for receiving the granular molding material to be compacted. A valve separates the pressure housing from the molding space, and selectively communicates the gaseous medium in the pressure housing with the molding space for compacting the granular molding material. A mechanical compaction plate is mounted in the molding space and defines with the pattern plate a volume of dead space. An adjustment element varies the volume of the dead space.

5 Claims, 2 Drawing Sheets

DEVICE FOR COMPACTING GRANULAR MOLDING MATERIAL

BACKGROUND OF THE INVENTION

The present invention is drawn to a device for compacting granular molding material and, more particularly, a device for compacting granular molding material by a pulse of compressed gas and/or mechanical squeeze.

There exists in the prior art various processes and devices for compacting granular molding materials which are particularly useful in producing sand molds for metal casting. The known devices include devices capable of providing a one-stage compaction by either a pulse of compressed gas or a mechanical squeeze and multi-stage compaction which includes a combination of gaseous pulses and mechanical squeeze. A particular useful device known in the prior art employs precompaction by a pressure surge of gaseous material followed by final compaction by mechanical squeeze.

Naturally, it would be highly desirable to provide a device which is capable of carrying out known compaction processes in a selective manner depending on the pattern requirements of the resulting sand mold.

Accordingly, it is the principal object of the present invention to provide a device for compacting granular molding materials in accordance with known compaction processes which may be operated selectively depending on the pattern requirements.

SUMMARY OF THE INVENTION

The foregoing objects and advantages are achieved by way of the present invention. In accordance with the present invention a device for compacting granular molding sand comprises a pressure housing for storing a gaseous medium under pressure. A valve assembly separates the pressure housing from the molding space of the device which is defined by a pattern plate having a molding box supported thereon. The valve assembly selectively communicates the gaseous medium in the pressure housing with the molding space for compacting the granular material. A mechanical compaction device in the form of a flexible squeeze plate is mounted in the molding space for compacting the granular molding material by a mechanical squeeze. The mechanical compaction plate defines in the mold space with the pattern plate a volume of dead space. In accordance with a particular feature of the present invention the volume of the dead space may be varied so as to control the pressure gradient, that is, the increase in pressure over time, which results from the application of the pressurized gaseous medium to the granular material for the compaction of same.

In accordance with one embodiment of the present invention, the volume of dead space is varied by controlling the height of the molding box. In a second embodiment of the present invention the volume of dead space is varied by controlling the position of the mechanical compaction plate in the molding space of the device.

Further objects and advantages of the present invention will appear hereinbelow.

DETAILED DESCRIPTION

The present invention is drawn to an improved device for compacting granular molding materials in accordance with known processes.

Figure 1:
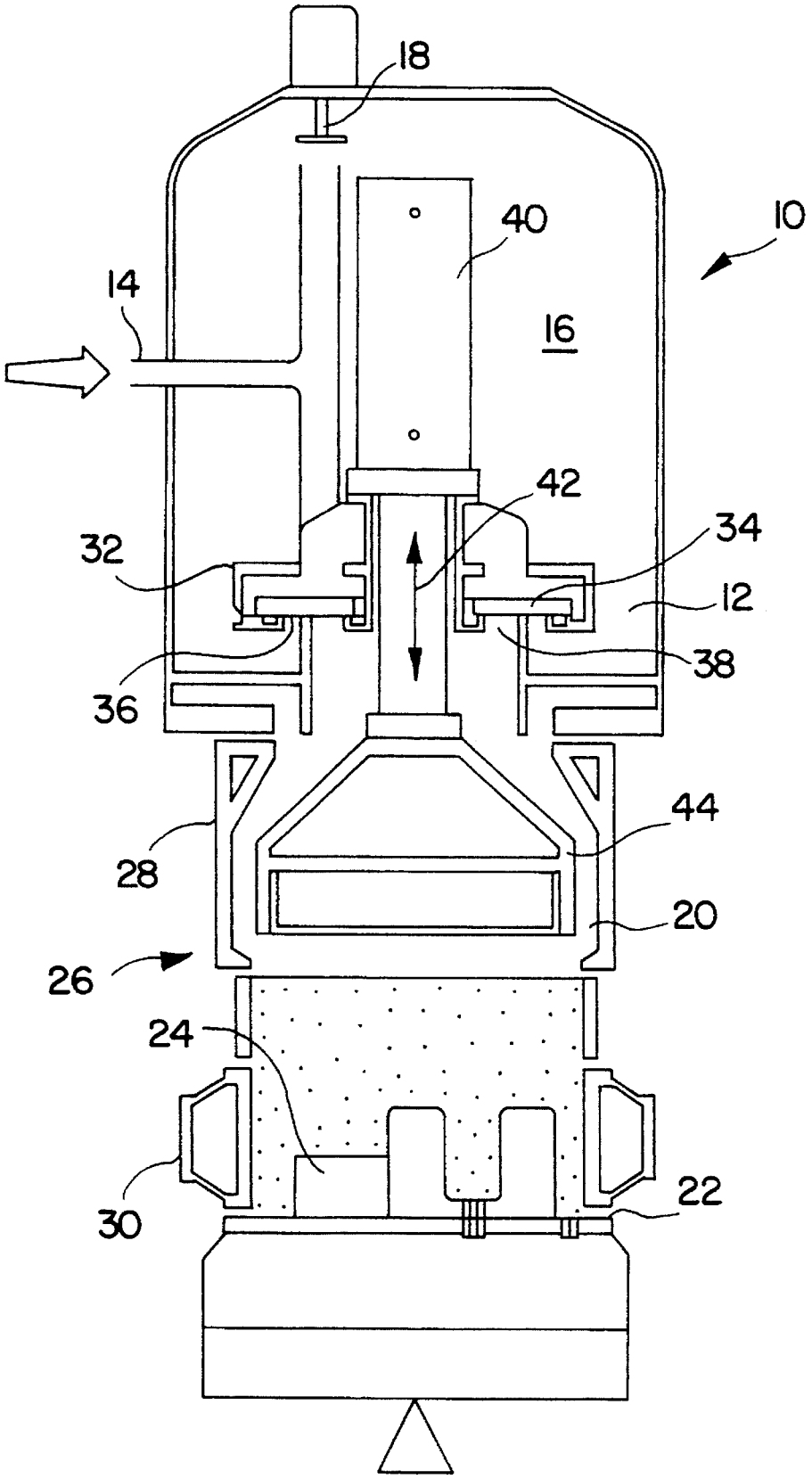
FIG. 1 is a cross-sectional schematic representation of a first embodiment of a compacting device in accordance with the present invention.

With reference to FIG. 1, a device 10 for compacting granular molding material is illustrated. The device comprises a pressure housing 12 for storing a gaseous medium under pressure. The gaseous medium under pressure is fed to the pressure housing 12 via feed line 14 and enters accumulator 16 when valve 18 is biased to the open position.

The molding space 20 of the device of the present invention is located beneath the pressure housing 12. The mold space 20 is defined by the pattern plate 22 having pattern 24 mounted thereon and molding box 26 which, as illustrated in FIG. 1, consists of two wall portions 28 and 30 respectively.

Disposed between the pressure housing 12 and the molding space 20 is a valve housing 32 in which ring shaped valve plate 34 is selectively moved (in a manner disclosed below) so as to communicate the pressurized gaseous medium in the pressure housing 12 with the molding space 20 when the valve plate 34 is lifted from its illustrated position to its uppermost position thereby communicating passages 36 and 38. A cylinder 40 is mounted on valve housing 32 within pressure housing 12. Cylinder 40, in a preferred embodiment of the present invention, receives piston rod 42 which has one end reciprocally mounted to a piston in cylinder 40 and the other end attached to pressure plate 44. The cylinder 40 may be connected to a pneumatic or hydraulic source in known manner for reciprocating the piston rod 42 so as to position the pressure plate 44 within the molding space 20. The positioning of the pressure plate 44 within the molding space 20 varies the volume of dead space in the molding space by reducing the volume of the dead space in the molding space, the pressure gradient of the gaseous medium pressure surge from the pressure housing 12 into the molding space 20 can be controlled.

The operation of FIG. 1 will now be discussed. With the compaction device in the position illustrated in FIG. 1, the pressurized gaseous medium is fed via conduit 14 by open valve 18 into pressure housing 12. Upon reaching the desired pressure in pressure housing 12 valve 18 may be closed. In this position the pressure across the valve plate 34 is such that the valve plate remains in the closed position as illustrated. The volume of dead space in the molding space is controlled by positioning the pressure plate 44 within the molding space by means of piston rod and cylinder arrangement 40,42. When the desired dead space is achieved, conduit 14 is vented thereby allowing pressure plate 34 to rise so as to communicate the pressurized gaseous medium in pressure housing 12 with the dead space 20 via passages 36 and 38. Once the pressure surge is applied, molding space 20 may be vented if desired and the granular molding material subjected to a further pressure surge or, in the alternative, mechanically pressed by pressure plate 44 by operation of the piston cylinder arrangement 40,42.

Figure 2:
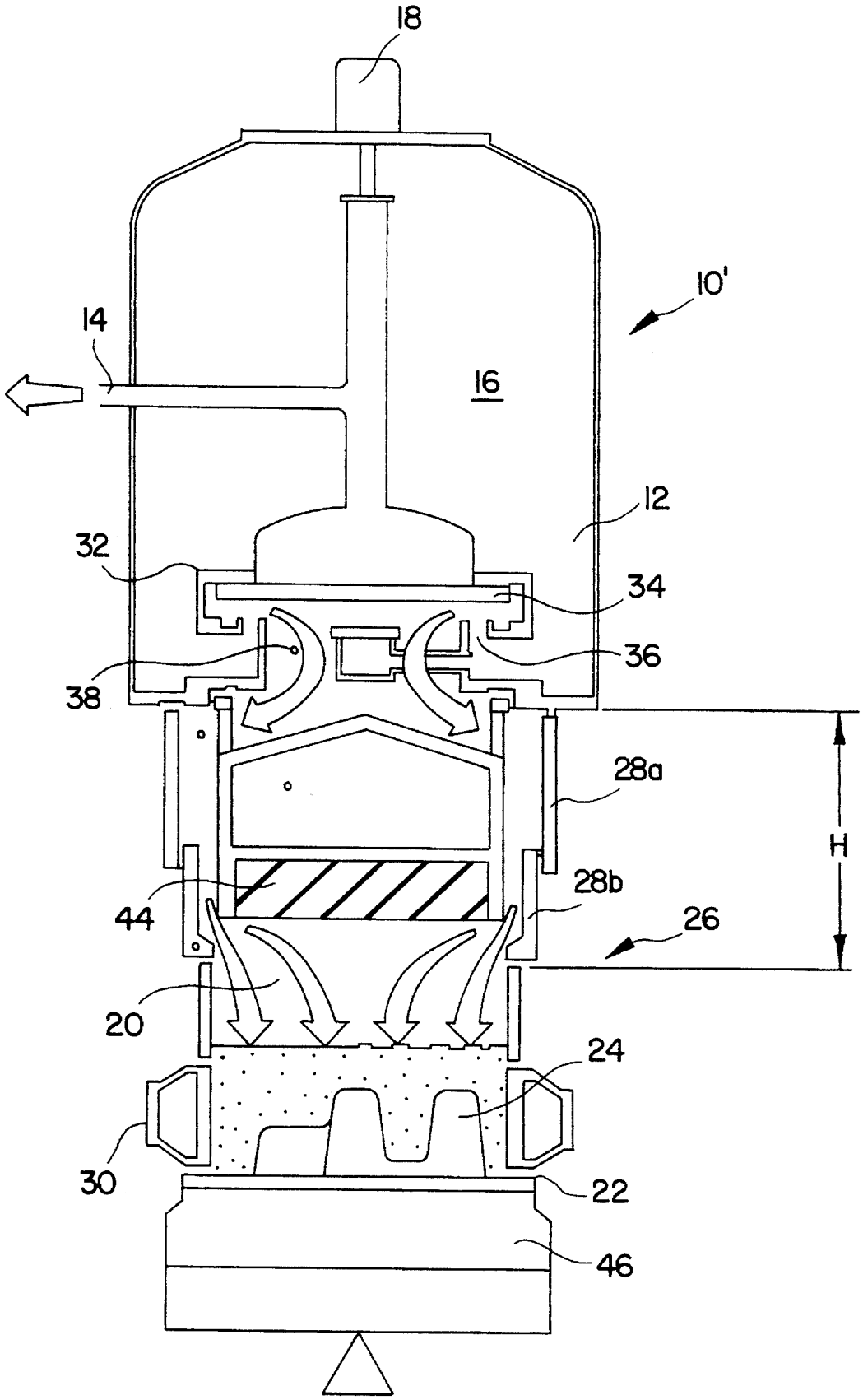
FIG. 2 is a cross-sectional schematic representation of a second embodiment of a compacting device in accordance with the present invention.

FIG. 2 illustrates a second embodiment of a device in accordance with the present invention. Like elements in FIG. 2 are designated with identical reference numbers as the embodiment of FIG. 1 discussed above.

In the embodiment of FIG. 2 the piston cylinder arrangement has been eliminated in order to vary the volume of the dead space in the molding space, the device 10' of FIG. 2 divides wall portion 28 of the molding box into first and second telescopically received wall portions which together define a height (H). Wall portion **28*b* is telescopically received in wall portion 28*a* by lifting the pattern plate 22 on plate 46 by suitable mechanical means known in the art. By controlling the height H of wall portion 28, the volume of dead space can be controlled so as to regulate the pressure gradient of the gaseous pressure surge in the same manner described above with reference to FIG. 1**.

In the embodiment of FIG. 2 the mechanical compression by pressure plate 44 is accomplished by lifting the pattern plate 22 with the granular molding material against the pressure plate 44 for the mechanical squeeze.

The embodiments of the present invention described above with regard to FIGS. 1 and 2 are designed so as to enable the volume of dead space to be reduced. As noted above, the volume of dead space has a harmful affect on the pressure gradient (the change of pressure over time) of the pressure surge of the gaseous medium. It is known in the art that the pressure gradient must be carefully controlled in order to obtain good compaction results on the granular material. In addition to the foregoing, by limiting the volume of the dead space, the amount of pressure medium required is significantly reduced thereby improving energy efficiency. The devices of the present invention allow for the dead space to be held to a minimum thereby creating a steep pressure gradient for precompaction with the gaseous medium. The steep pressure gradient insures good compaction results. Finally, as pointed out above, the devices of the present invention allow for the practice of the different known compaction processes described in the prior art which may consist of single or multiple gas pressure surges with or without mechanical squeeze.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A device for compacting granular molding material comprising:

pressure housing means for storing a gaseous medium under pressure;

pattern plate means for supporting a pattern plate;

molding box means of a height associated with the pattern plate means and defining therewith a molding space for receiving the granular molding material to be compacted, said molding box means includes a sidewall portion having a first wall portion telescopically received in a second wall portion for varying the height of the molding box means;

valve means separating the pressure housing means from the molding space, the valve means including means for selectively communicating the gaseous medium in the pressure housing means with the molding space for compacting the granular molding material;

mechanical compaction means mounted in the molding space and defining with the pattern plate means a volume of dead space; and means for varying the volume of the dead space, said means for varying the volume of the dead space comprises means for varying the height of the molding box means wherein said means for varying the height includes means for moving the pattern plate means vertically whereby the first wall portion moves relative to the second wall portion.

2. A device according to claim 1 wherein the mechanical compaction means is stationary.

3. A device according to claim 2 wherein the valve means includes a flat disc valve plate.

4. A device according to claim 1 wherein the mechanical compaction means includes a flexible plate.

5. A device for compacting granular molding material comprising:

pressure housing means for storing a gaseous medium under pressure;

pattern plate means for supporting a pattern plate;

molding box means of a height associated with the pattern plate means and defining therewith a molding space for receiving the granular molding material to be compacted;

valve means separating the pressure housing means from the molding space, the valve means including means for selectively communicating the gaseous medium in the pressure housing means with the molding space for compacting the granular molding material, the valve means further includes a ring-shaped valve plate mounted in a valve housing, the valve housing having a central bore;

mechanical compaction means mounted in the molding space and defining with the pattern plate means a volume of dead space; and means for varying the volume of the dead space, the means for varying the volume of the dead space comprises a cylinder mounted on the valve housing within the pressure housing means, a piston rod reciprocally mounted in the central bore and having one end reciprocally mounted in the cylinder and another end fixed to the mechanical compaction means and means for reciprocating the piston rod for varying the volume of dead space.

* * * * *

UNITED STATES PATENT AND TRADEMARK OFFICE

CERTIFICATE OF CORRECTION

PATENT NO. : 5,476,136

DATED : December 19, 1995

INVENTOR(S) : Hans Leutwiler et al.

It is certified that error appears in the above-indentified patent and that said Letters Patent is hereby corrected as shown below:

Column 4, line 22, claim 4, change the dependency from "1" to --5--.

Signed and Sealed this

Tenth Day of September, 1996

*Attest:*

Bruce Lehman

BRUCE LEHMAN

*Attesting Officer*

*Commissioner of Patents and Trademarks*